US009788595B1

(12) United States Patent
Heaven

(10) Patent No.: US 9,788,595 B1
(45) Date of Patent: Oct. 17, 2017

(54) ARTICLE OF FOOTWEAR WITH INTERCHANGEABLE DECORATIVE FEATURES

(71) Applicant: Diana Heaven, Lauderhill, FL (US)

(72) Inventor: Diana Heaven, Lauderhill, FL (US)

( * ) Notice: Subject to any disclaimer, the term of this patent is extended or adjusted under 35 U.S.C. 154(b) by 0 days.

(21) Appl. No.: 14/955,683

(22) Filed: Dec. 1, 2015

(51) Int. Cl.

| | |
|---|---|
| ***A43B 3/24*** | (2006.01) |
| ***A43B 3/12*** | (2006.01) |
| ***A43B 23/24*** | (2006.01) |
| ***A43B 13/12*** | (2006.01) |
| ***A43B 13/04*** | (2006.01) |

(52) U.S. Cl.
CPC ..... *A43B 3/122* (2013.01); *A43B 13/04* (2013.01); *A43B 13/12* (2013.01); *A43B 23/24* (2013.01)

(58) Field of Classification Search
CPC ..... A43B 3/122; A43B 13/04; A43B 13/12; A43B 23/24
USPC ..... 36/100, 101, 132, 136
See application file for complete search history.

(56) References Cited

U.S. PATENT DOCUMENTS

| | | | | |
|---|---|---|---|---|
| 2,491,930 | A | 12/1949 | Frank et al. | |
| 7,347,010 | B2 * | 3/2008 | Yu | A43B 1/0036 36/100 |
| D611,694 | S | 3/2010 | Cheslock | |
| 7,698,834 | B1 | 4/2010 | Courville | |
| 7,819,721 | B1 * | 10/2010 | Messier | A41D 27/08 2/244 |
| D627,551 | S | 11/2010 | Berutich et al. | |
| 8,381,415 | B1 * | 2/2013 | Lanoue | A43B 3/102 36/11.5 |
| 8,413,350 | B2 * | 4/2013 | Scozzafava | A43B 3/122 36/101 |
| 8,421,822 | B2 | 4/2013 | Odland et al. | |
| 2002/0152638 | A1 | 10/2002 | Safdeye et al. | |
| 2003/0009919 | A1 | 1/2003 | Stein | |
| 2006/0112597 | A1 * | 6/2006 | Stern | A43B 3/103 36/101 |
| 2006/0174514 | A1 * | 8/2006 | Scozzafava | A43B 3/122 36/11.5 |
| 2009/0193684 | A1 * | 8/2009 | Diamond | A43B 1/0081 36/101 |
| 2009/0300948 | A1 * | 12/2009 | Nordstrom-Wehner | A43B 3/0078 36/136 |
| 2010/0037486 | A1 | 2/2010 | Verheijen | |
| 2010/0083533 | A1 | 4/2010 | Terner et al. | |
| 2012/0192331 | A1 | 8/2012 | Fowler et al. | |

(Continued)

FOREIGN PATENT DOCUMENTS

| | | | |
|---|---|---|---|
| WO | WO2010083533 | A2 | 7/2010 |

*Primary Examiner* — Jila M Mohandesi
(74) *Attorney, Agent, or Firm* — The Concept Law Group, P.A.; Scott D. Smiley; Yongae Jun

(57) ABSTRACT

An article of footwear having a sole member is disclosed. The sole member includes an outsole defining a ground-contacting portion of the sole member; an insole defining a foot-contacting portion of the sole member; and a fastening member coupled to a peripheral edge of at least one of the outsole and the insole. The fastening member includes a body with a hook arm protruding from a portion of the body, the hook arm and the portion together disposed above the insole and defining a discontinuous gap in the body; and a coupling strap with a first end and a second end opposite the first end, the first end extending outwardly from the peripheral edge and the second end coupled to the portion of the body.

17 Claims, 12 Drawing Sheets

(56) References Cited

U.S. PATENT DOCUMENTS

| | | | |
|---|---|---|---|
| 2013/0174327 | A1 | 7/2013 | Baum |
| 2014/0109440 | A1 | 4/2014 | McDowell et al. |
| 2014/0137436 | A1 | 5/2014 | Saccullo et al. |
| 2014/0259777 | A1 | 9/2014 | Morris Thill |
| 2015/0019372 | A1 | 1/2015 | Fox |

* cited by examiner

ARTICLE OF FOOTWEAR WITH INTERCHANGEABLE DECORATIVE FEATURES

FIELD OF THE INVENTION

The present invention relates generally to an article of footwear, and more particularly relates to an article of footwear that includes a fastening member operable to allow a user to selectively couple decorative features to the article of footwear.

BACKGROUND OF THE INVENTION

Users desire variety in footwear and flexibility of styles for varying occasions and matching to different clothing outfits. Users typically obtain this variety by purchasing many different articles of footwear. Unfortunately, this can become very costly. In addition, users desire the feeling of uniqueness when wearing footwear, or any clothing item or accessory for that matter. For example, users who attend the same event wearing the same clothing item will inevitably experience an amount of social embarrassment. Such users may choose to no longer wear said clothing item for fear of a repeat offense. Unfortunately, current systems and method for allowing users to personalize footwear and obtain a variety of styles, which do not include the user merely purchasing more pairs of shoes, are very limited. Furthermore, such systems and methods typically include complicated attachment systems that are expensive to manufacture and difficult to use.

Therefore, a need exists to overcome the problems with the prior art as discussed above.

SUMMARY OF THE INVENTION

The invention provides an article of footwear with interchangeable decorative features that overcomes the hereinafore-mentioned disadvantages of the heretofore-known devices and methods of this general type.

With the foregoing and other objects in view, there is provided, in accordance with the invention, a sole member for an article of footwear. The sole member includes an outsole defining a ground-contacting portion of the sole member and an insole defining a foot-contacting portion of the sole member. A first fastening member is coupled to a peripheral edge of at least one of the outsole and the insole, the first fastening member including a body with a hook arm protruding from a portion of the body. The hook arm and the portion together are disposed above the insole and define a discontinuous gap in the body. The a first fastening member also includes a coupling strap with a first end and a second end opposite the first end, the first end extending outwardly from the peripheral edge of the at least one of the outsole and the insole. The second end is coupled to the portion of the body of the first fastening member.

In accordance with another feature, an embodiment of the present invention includes the portion of the body formed as a closed-loop portion and the second end of the coupling strap folded over the closed-loop portion of the body so as to form a loop about at least a portion of the closed-loop portion.

In accordance with a further feature of the present invention, the discontinuous gap is sized and configured to receive a footwear strap therethrough, and an opening of the discontinuous gap is oriented towards a heel portion of the sole member.

In accordance with a further feature of the present invention, the sole member includes a footwear strap having a first end and a second end opposite the first end, wherein the first end is fixedly coupled to the peripheral edge of the at least one of the outsole and the insole on one side of the sole member and the second end is selectively couplable to the first fastening member disposed on an opposing side of the sole member.

In accordance with a further feature of the present invention, the coupling strap includes a fastener disposed on an exterior surface thereof, and the footwear strap includes a flap disposed at the second end of the footwear strap, the flap having a mating fastener disposed on an interior surface thereof and configured so as to substantially conceal the hook arm when the fastener and the mating fastener are engaged.

In accordance with a further feature of the present invention, the coupling strap is of a flexible material and the body is of a material that is more rigid than the coupling strap.

In accordance with another further feature of the present invention, the hook arm of the body does not contact the coupling strap.

In accordance with a further feature of the present invention, the body is of a plastic material.

In accordance with yet another feature of the present invention, the sole member includes a rear fastening member extending outwardly from a rear portion of the peripheral edge of the sole member, the rear fastening member including a pivot and at least a portion of the rear fastening member rotatable about the pivot.

In accordance with a further feature of the present invention, at least the portion of the rear fastening member is rotatable at least 45 degrees about a vertical axis defined by the pivot.

In accordance with a further feature of the present invention, a second rear fastening member extends outwardly from the rear portion of the peripheral edge of the sole member, the second rear fastening member including a second pivot and at least a portion of the second rear fastening member rotatable about the second pivot. The rear fastening member and the second rear fastening member are disposed on opposing sides of the sole member, and the rear fastening member and the second rear fastening member are rotatable at least 45 degrees about the pivot and second pivot, respectively.

In accordance with a further feature of the present invention, the sole member is formed as a sole of a wedge sandal.

In accordance with another feature, an embodiment of the present invention includes a decorative footwear kit including a sole member having an outsole defining a ground-contacting portion of the sole member, an insole defining a foot-contacting portion of the sole member, and a first fastening member coupled to a peripheral edge of at least one of the outsole and the insole. The first fastening member includes a body with a hook arm protruding from a portion of the body, the hook arm and the portion together are disposed above the insole and define a discontinuous gap in the body. The first fastening member may also include a coupling strap with a first end and a second end opposite the first end, the first end extending outwardly from the peripheral edge of the at least one of the outsole and the insole and the second end coupled to the portion of the body, and at least one footwear strap selectively couplable to the first fastening member.

In accordance with a further feature of the present invention, the portion of the body is formed as a closed-loop portion and the second end of the coupling strap is folded over the closed-loop portion of the body so as to form a loop about at least a portion of the closed-loop portion.

In accordance with a further feature of the present invention, the discontinuous gap is sized and configured to receive the at least one footwear strap therethrough, and an opening of the discontinuous gap is oriented towards a heel portion of the sole member.

In accordance with a further feature of the present invention, at least one decorative member is selectively couplable to the at least one footwear strap.

In accordance with a further feature of the present invention, the at least one decorative member includes a loop sized and configured to slideably receive the at least one footwear strap therethrough for selectively coupling the at least one decorative member to the at least one footwear strap.

In accordance with a further feature of the present invention, the at least one footwear strap has a first end and a second end opposite the first end, the first end fixedly coupled to the peripheral edge of the at least one of the outsole and the insole on one side of the sole member and the second end selectively couplable to the first fastening member disposed on an opposing side of the sole member.

In accordance with another feature of the present invention, a rear fastening member extends outwardly from a rear portion of the peripheral edge of the sole member, the rear fastening member including a pivot and at least a portion of the rear fastening member rotatable about the pivot and wherein the at least one footwear strap includes an ankle strap selectively couplable to the rear fastening member.

In accordance with yet another feature, an embodiment of the present invention includes a plurality of decorative members selectively couplable to the at least one footwear strap, wherein at least one of the plurality of decorative members is visually distinguishable from another one of the plurality of decorative members.

Although the invention is illustrated and described herein as embodied in an article of footwear with interchangeable decorative features, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the sole member. The terms "program," "software application," and the like as used herein, are defined as a sequence of instructions designed for execution on a computer system. A "program," "computer program," or "software application" may include a subroutine, a function, a procedure, an object method, an object implementation, an executable application, an applet, a servlet, a source code, an object code, a shared library/dynamic load library and/or other sequence of instructions designed for execution on a computer system.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
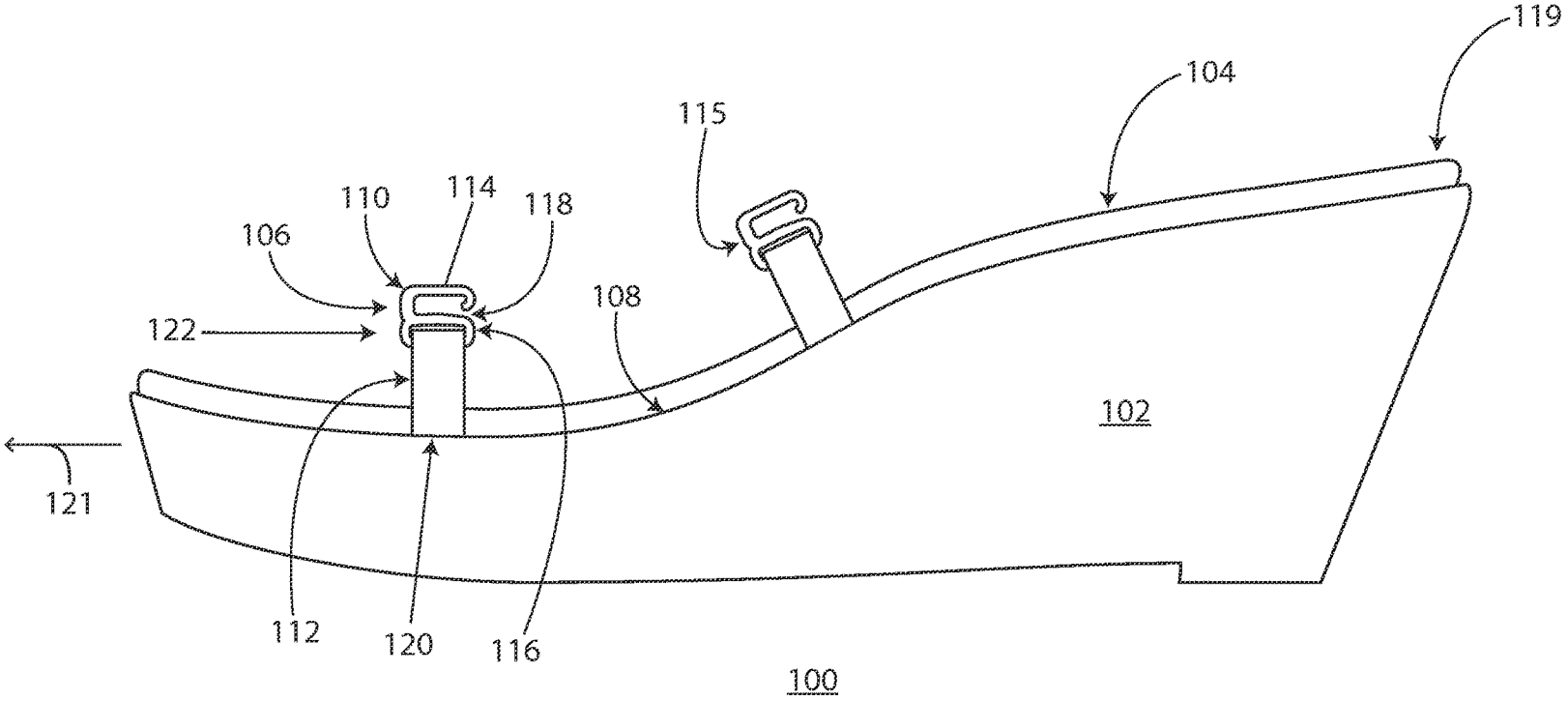
FIG. 1 is a side perspective view of a sole member for an article of footwear in accordance with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient article of footwear and footwear kit having a sole member with fasteners that allow a user to selectively interchange decorative features, foot supporting/retaining straps, footwear uppers, etc., to provide the user with decorative variety, without requiring the costly purchase of additional pairs of shoes. Embodiments of the invention provide an article of footwear with a fastening member; at least one footwear strap selectively couplable to the fastening member; and one or more visually distinguishable decorative members slideably couplable to the footwear strap. In addition, embodiments of the invention provide an easy to use and secure fastening member, similar to a bra-strap fastener, having a hook arm configured and oriented to allow the footwear strap to selectively couple to the hook arm for slideably attaching and detaching decorative members to the article of footwear. Embodiments of the invention can be provided in a variety of types of footwear, including but not limited to, sandals, pumps, boots, and the like.

Referring now to FIG. 1, one embodiment of the present invention is shown in a side perspective view. FIG. 1 shows several advantageous features of the present invention, but, as will be described below, the invention can be provided in several shapes, sizes, combinations of features and components, and varying numbers and functions of the components. The first example of a sole member 100, as shown in FIG. 1, includes an outsole 102 and an insole 104. As used herein, the term "sole member" is intended to indicate the portion of an article of footwear beneath the wearer's foot, excluding the heel. As used herein, the term "outsole" is intended to indicate the portion of the sole member that is in contact with the ground. Stated another way, the outsole 102 defines the ground-contacting portion of the sole member 100. As used herein, the term "insole" is intended to indicate the portion of the sole member that is disposed directly beneath the wearer's foot. In other words, the insole 104 defines the foot-contacting portion of the sole member 100. In one embodiment, the sole member 100 is provided without an upper (not shown). In another embodiment, the sole member 100 is provided with an upper (not shown) selectively couplable to the sole member 100. The sole member 100 may be formed as a wedge sandal, as depicted in FIG. 1. In other embodiments, the sole member 100 may be formed as other articles of footwear, such as, for example, a closed-toe pump, a peep-toe pump, a boot, a sling back, sandal flats, or any type of footwear.

In one embodiment, the sole member 100 includes a first fastening member 106. In other embodiments, the sole member 100 may include a plurality of fastening members 106. In another embodiment, the first fastening member 106 is coupled to a peripheral edge 108 of the outsole 102. In another embodiment, the first fastening member 106 is coupled to a peripheral edge of the insole 104. In another embodiment, the first fastening member 106 includes a body 110 and a coupling strap 112. In one embodiment, the body 110 has a hook arm 114 protruding from a portion 116 of the body 110. In another embodiment, the hook arm 114 and the portion 116 together are disposed above the insole 104. In yet another embodiment, the hook arm 114 and the portion 116 together define a discontinuous gap 118 in the body 110. In one embodiment, the discontinuous gap 118 is sized and configured to receive a footwear strap (not shown) therethrough for selectively securing the footwear strap (not shown) to the sole member 100. In a preferred embodiment, the discontinuous gap 118 is oriented towards a heel portion 119 of the sole member 100. Advantageously, this orientation allows the footwear strap (not shown) to be more securely retained within the discontinuous gap 118 because as the wearer moves in a forward direction, the footwear strap (not shown) will be blocked by a neck 115 of the body 110. In embodiments where the discontinuous gap 118 is oriented towards a toe area of the sole member 100, the wearer's forward movement may cause the footwear strap (not shown) to move outside of the discontinuous gap 118 and eventually cause the footwear strap (not shown) to uncouple from the hook arm 114.

In one embodiment, the hook arm 114 does not contact the coupling strap 112. As used herein, the term "contact" is intended to indicate direct physical touching. In another embodiment, the coupling strap 112 is of a flexible material, such as, for example, a leather material, a fabric material, a flexible polymer-based material, and the like. In another embodiment, the body 110 is of a material that is more rigid than the coupling strap 112. In one embodiment, the body 110 is of a plastic material. In another embodiment, the body 110 is of another material.

In one embodiment, the coupling strap 112 includes a first end 120 and a second end 122 opposite the first end 120. In another embodiment, the first end 120 extends outwardly from the peripheral edge 108. In another embodiment, the first end 120 is fixedly coupled to the peripheral edge 108. As used herein, the term "fixedly coupled" is intended to indicate a coupling of objects that that is not configured for allowing a user to selectively uncouple the objects. In other words, objects that are "fixedly coupled" together are designed to remain coupled during the functional lifetime of the objects, where uncoupling the objects would damage said objects for their intended use. For example, the first end 120 may be sown to the peripheral edge 108 or fixed to the peripheral edge 108 by another fastening material. In one embodiment, the second end 122 is coupled to the portion 116 of the body 110. In another embodiment, the second end 122 is fixedly coupled to the portion 116 of the body 110. In one embodiment, the portion 116 of the body 110 is formed as a closed-loop portion. As used herein, the term "closed-loop" is intended to indicate a curve or bending of a length so as to form a closed curve with itself. In another embodiment, the second end 112 of the coupling strap 112 is folded over the closed-loop portion 116 of the body 110 so as to form a closed-loop about at least a portion of the closed-loop portion 116 of the body 110. In a further embodiment, the coupling strap 112 may be folded over and sewn to itself, so as to secure the coupling strap 112 to the body 110.

Figure 2:
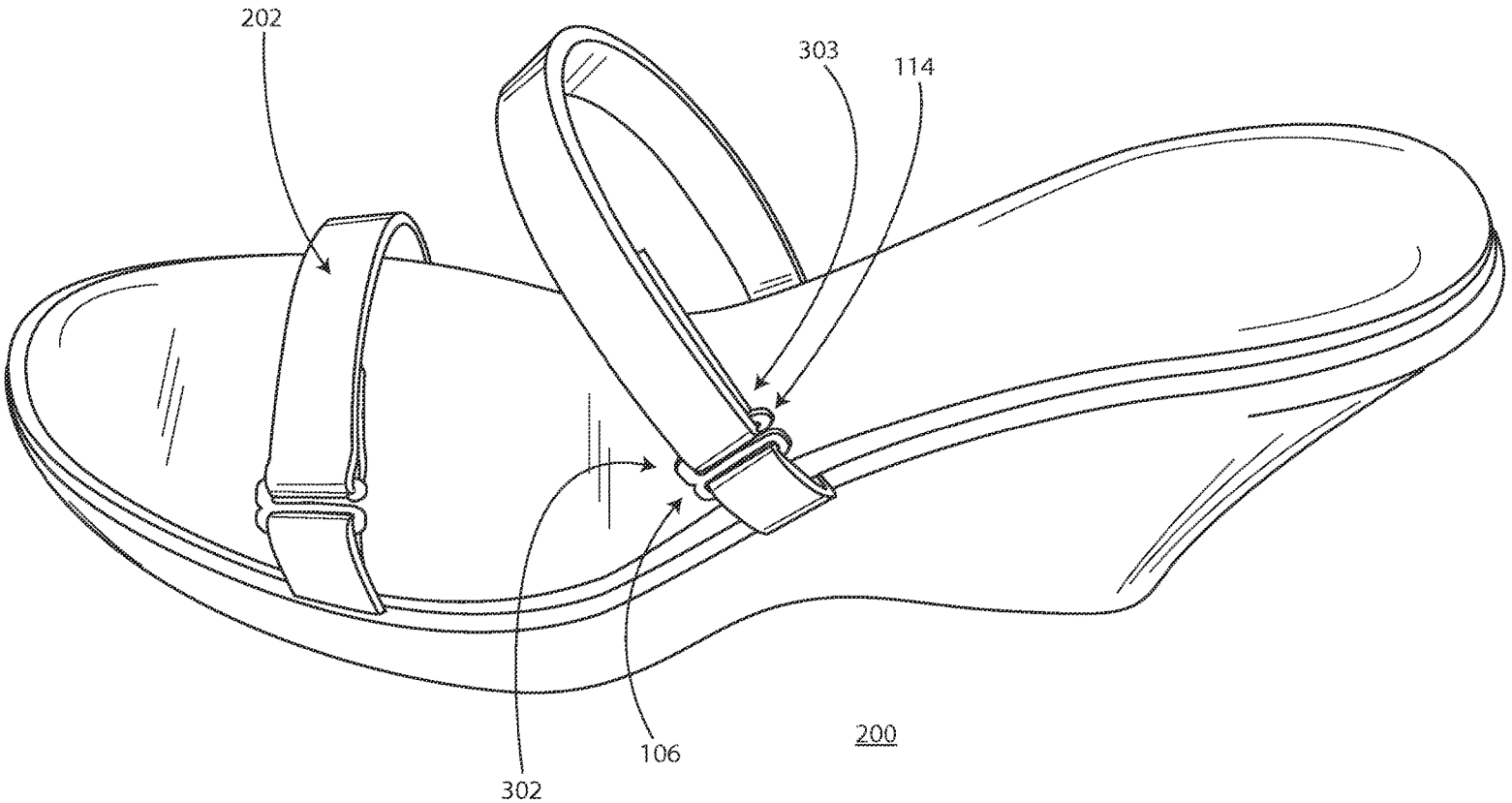
FIG. 2 is a side perspective view of a wedge sandal in accordance with the present invention.
Figure 3:
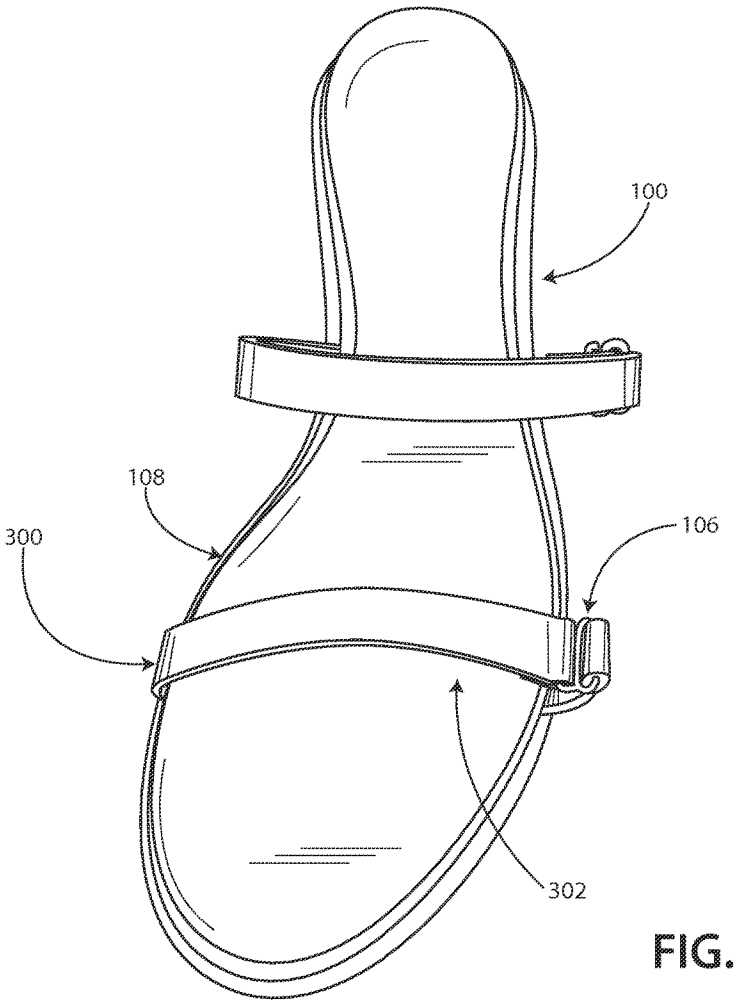
FIG. 3 is a top perspective view of the wedge sandal of FIG. 2 in accordance with the present invention.

Referring to FIGS. 2-3, another exemplary embodiment of an article of footwear 200 in accordance with the present invention is illustrated. The footwear 200 is substantially similar to the sole member 100 in FIG. 1, except that the footwear 200 also includes footwear straps 202 that secure the foot to the sole member 100. In one embodiment, the footwear 200 may include a plurality of footwear straps 202. In one embodiment, the footwear strap 202 includes a first end 300 and a second end 302 opposite the first end 300. In another embodiment, the first end 300 is fixedly coupled to the peripheral edge 108 of the sole member 100 on one side of the sole member 100. In an embodiment where at least one end of the footwear strap 202 is fixedly coupled to the sole member 100, retention of the wearer's foot by the footwear strap 202 may be more secure. In another embodiment, the second end 302 is selectively couplable to the first fastening member 106 disposed on an opposing side of the sole member 100. Advantageously, this allows the wearer to selectively uncouple the second end 302 of the footwear strap 202 so as to slide on or otherwise fasten one or more decorative members (not shown) to the footwear strap 202. In another embodiment, the first end 300 is selectively couplable to the peripheral edge 108. In yet another embodiment, the second end 302 is fixedly coupled to the peripheral edge 108. In one embodiment, the second end 302 of the footwear strap 202 is formed as a loop 303 defining an aperture through which the hook arm 114 may slide completely through for securing the footwear strap 202 to the hook arm 114.

Figure 4:
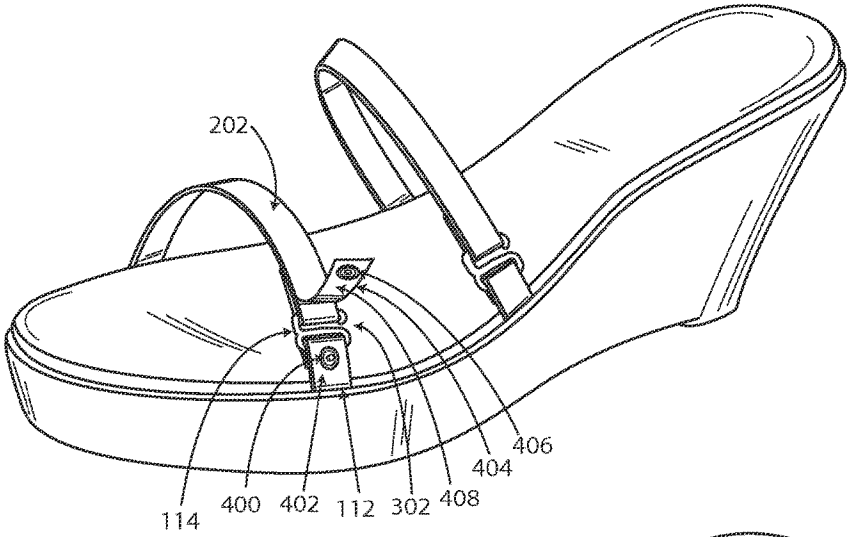
FIG. 4 is a partial side perspective view of another exemplary wedge sandal having a concealing flap in accordance with the present invention.
Figure 5:
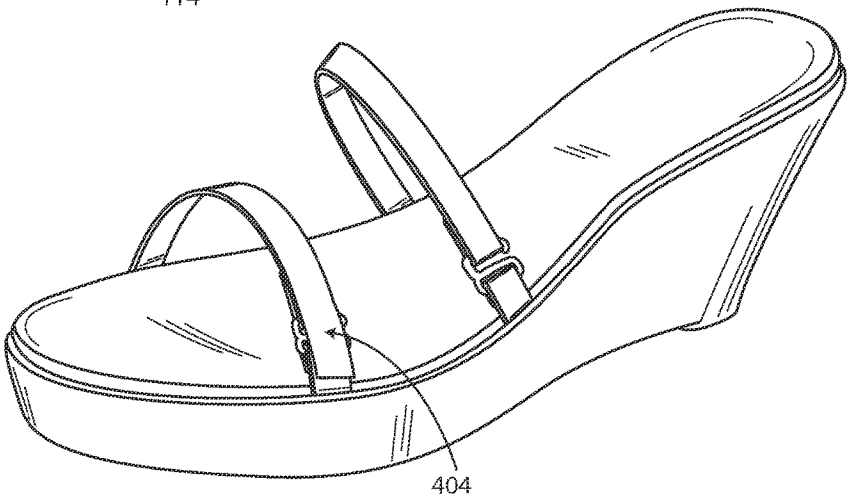
FIG. 5 is a partial front perspective view of the wedge sandal of FIG. 4 illustrating the concealing flap in a fastened configuration in accordance with the present invention.

Referring to FIGS. 4-5, the coupling strap 112 may include a fastener 400 disposed on an exterior surface 402 thereof. In one embodiment, the fastener 400 may be a snap fastener. In other embodiments, the fastener 400 may be any type of known fastener, such as a hook or loop fastener, and the like. In another embodiment, the footwear strap 202 includes a flap 404 disposed at the second end 302 of the footwear strap 202. In another embodiment, the flap 404 is sized and shaped so as to cover the first fastening member 106 so that it is not externally visible. Advantageously, this presents a more aesthetic appearance, where fastening members are not readily visible to the external environment. In one embodiment, the flap 404 includes a mating fastener 406 disposed on an interior surface 408 thereof. In another embodiment, the flap 404 is configured so as to substantially conceal the hook arm 114 when the fastener 400 and mating fastener 406 are engaged, as can be seen in FIG. 5.

Figure 7:
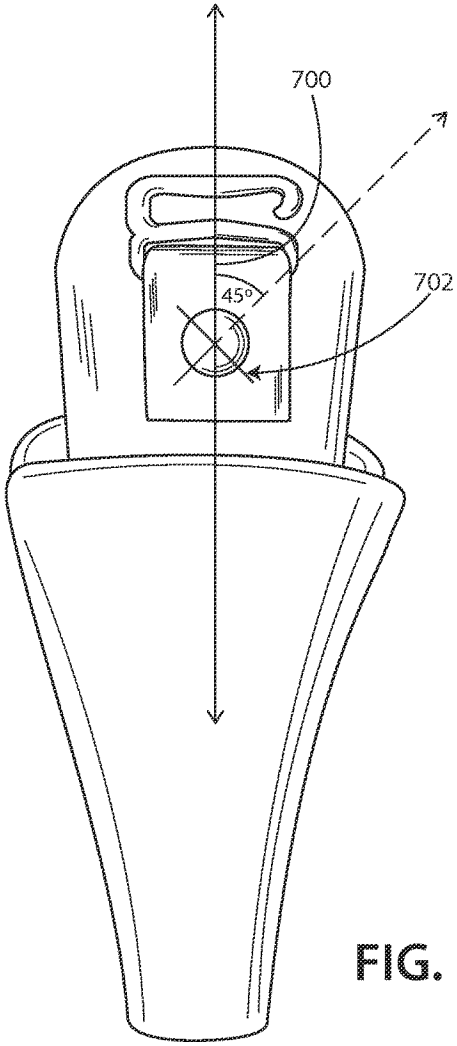
FIG. 7 is a rear elevational view of the wedge sandal of FIG. 2, illustrating the rear rotatable fastening member rotated approximately 45 degrees about a pivot, in accordance with the present invention.
Figure 6:
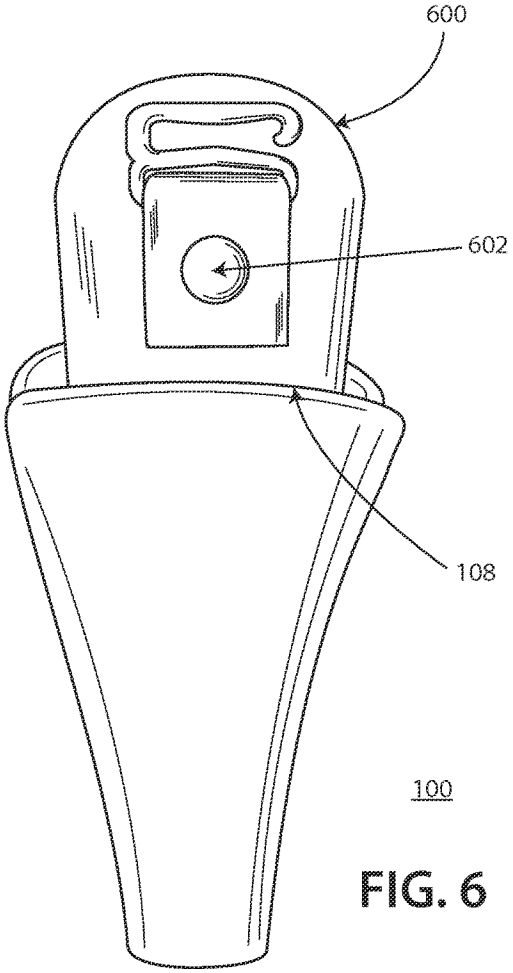
FIG. 6 is a rear elevational view of the wedge sandal of FIG. 2, illustrating a rear rotatable fastening member, in accordance with the present invention.

Referring to FIGS. 6-7, the sole member 100 may include a rear fastening member 600. In one embodiment, the rear fastening member 600 extends outwardly from a rear portion of the peripheral edge 108 of the sole member 100. In another embodiment, the rear fastening member 600 includes a pivot 602. The rear fastening member 600 may be rotatable about the pivot 602. In a further embodiment, the rear fastening member 600 is rotatable at least 45 degrees about a vertical axis 700 defined by the pivot 602. In yet a further embodiment, the rear fastening member 600 is rotatable at least 90 degrees about the vertical axis 700. In yet another embodiment, the rear fastening member 600 is rotatable less than 45 degrees about the vertical axis 700. In one embodiment, the pivot 602 can be said to define an imaginary central axis 702 passing through the rear fastening member 600 and extending in a longitudinal direction from the rear heel portion of the sole member 100 toward the front toe portion of the sole member 100.

Figure 9:
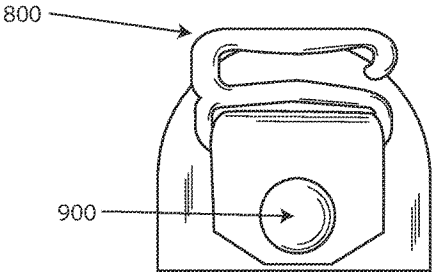
FIG. 9 is an enlarged view of the rotatable fastening member of the article of footwear in FIG. 8 in accordance with the present invention.
Figure 8:
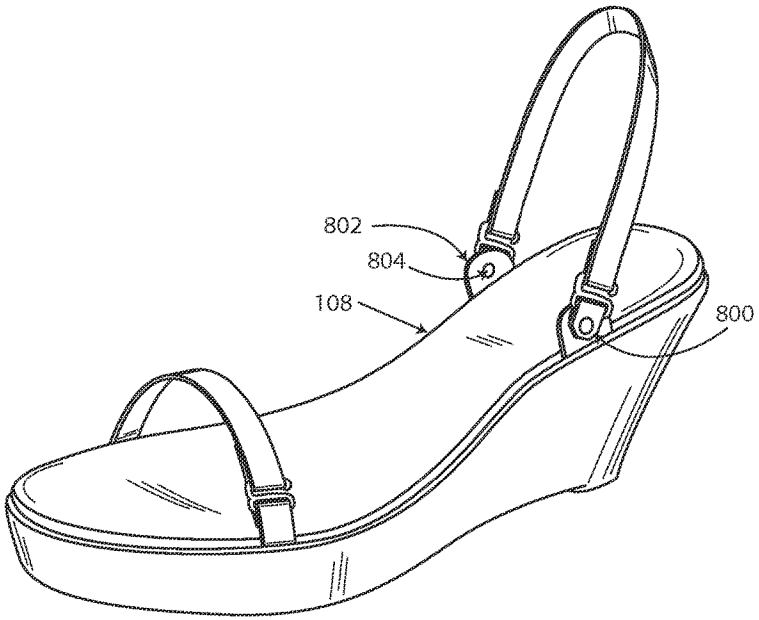
FIG. 8 is a side perspective view of another exemplary embodiment of an article of footwear, illustrating a side rotatable fastening member, in accordance with the present invention.
Figure 10:
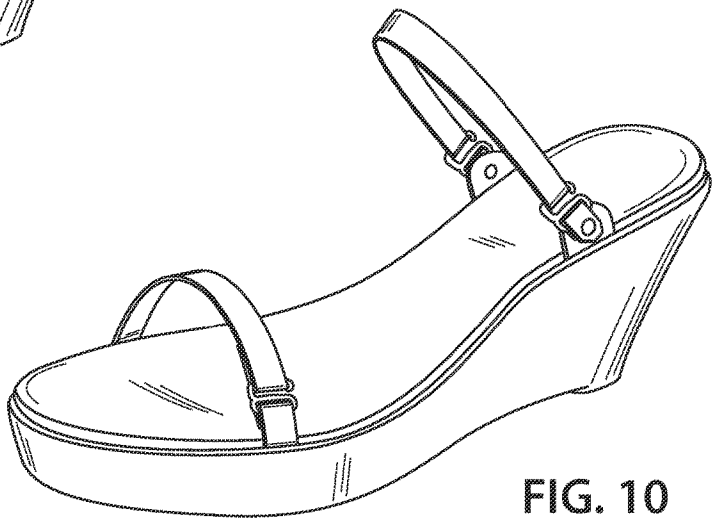
FIG. 10 is a side perspective view of the article of footwear in FIG. 8 with a decorative ankle strap selectively fastened thereto in accordance with the present invention.

Referring to FIGS. 8-9, the sole member 100 may include a second rear fastening member 800 extending outwardly from the rear portion of the peripheral edge 108 of the sole member 100. In one embodiment, the rear fastening member 800 includes a pivot 900 and at least a portion of the second rear fastening member 800 is rotatable about the pivot 900. In another embodiment, the sole member 100 may include a third rear fastening member 802 with a pivot 804. In another embodiment, the third rear fastening member 802 and the second rear fastening member 800 are disposed on opposing sides of the sole member 100. In yet another embodiment, the third rear fastening member 802 and the second rear fastening member 800 are rotatable at least 45 degrees about the corresponding pivots 804, 900. In yet a further embodiment, the third rear fastening member 802 and the second rear fastening member 800 are rotatable at least 90 degrees about the corresponding pivots 804, 900. In yet another embodiment, the third rear fastening member 802 and the second rear fastening member 800 are rotatable less than 45 degrees about the corresponding pivots 804, 900. The rotatable aspect of the fastening members is advantageous because as differently configured footwear straps are selectively coupled to the fastening members, the desired orientation of the footwear straps may depend on the size, shape, and/or configuration of the footwear strap. Said rotation provides flexibility in design. For example, FIG. 8 illustrates an ankle strap angularly oriented toward the absolute rear end of the sole member 100, whereas FIG. 10 illustrates another exemplary ankle strap oriented toward the front portion of the sole member 100. Without the rotational functionality provided by the pivots, the wearer may be limited to one particular ankle strap orientation.

Figure 12:
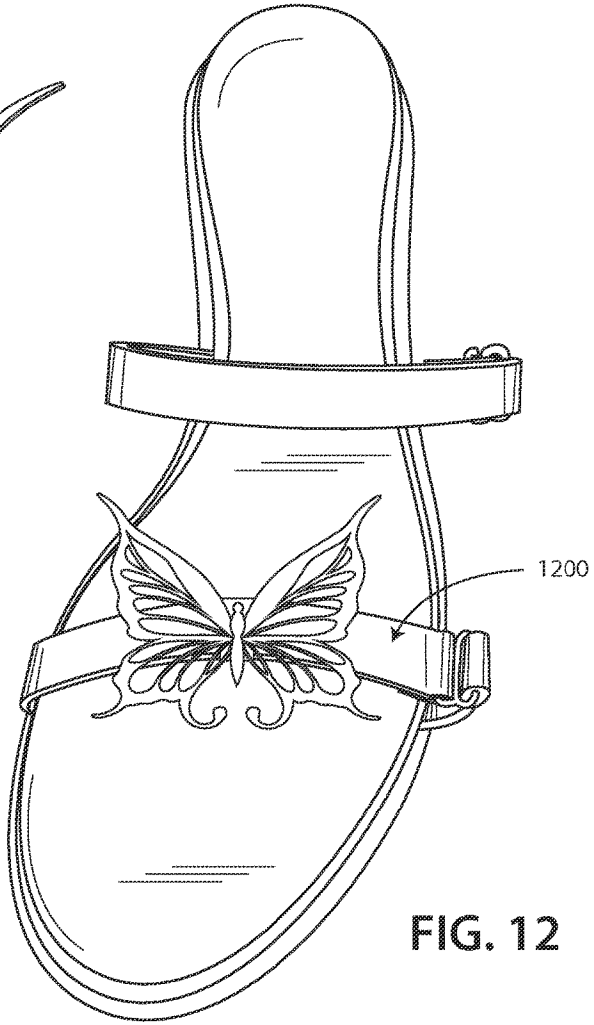
FIG. 12 is a top perspective view of the decorative member of FIG. 11 selectively coupled to the article of footwear in FIG. 8 in accordance with the present invention.
Figure 11:
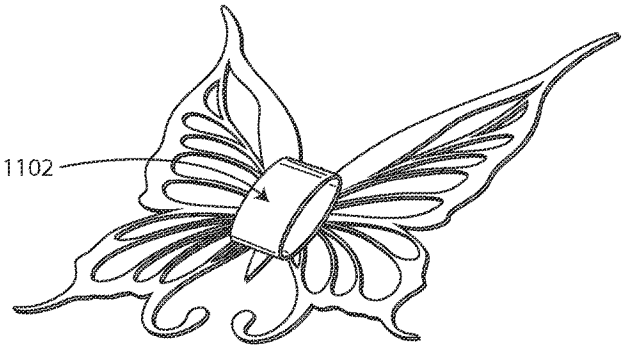
FIG. 11 is a top perspective view of a decorative member with a loop fastener in accordance with the present invention.

Referring to FIGS. 11-12, the sole member 100 can be provided as a kit that also includes at least one footwear strap 1200 selectively couplable to one or more fastening members. In a further embodiment, the kit may also include one or more decorative members 1100. In one embodiment, the decorative member 1100 may include a loop 1102 sized and configured to slideably receive the footwear strap 1200 therethrough for selectively coupling the decorative member 1100 to the footwear strap 1200. The decorative member 1100 can be any decorative or ornamental feature, charm, or aspect. In one embodiment, the kit includes a plurality of decorative members 1100, each selectively couplable to the footwear strap 1200. In a preferred embodiment, each of the plurality of decorative members 1100 is visually distinguishable from one another. Stated another way, each of the plurality of decorative members 1100 is different from one another so as to allow the user to interchange the decorative members 1100 to provide variety and personalization of an article of footwear. In one embodiment, the sole member 100 includes a plurality of footwear straps 1200.

Figure 13:
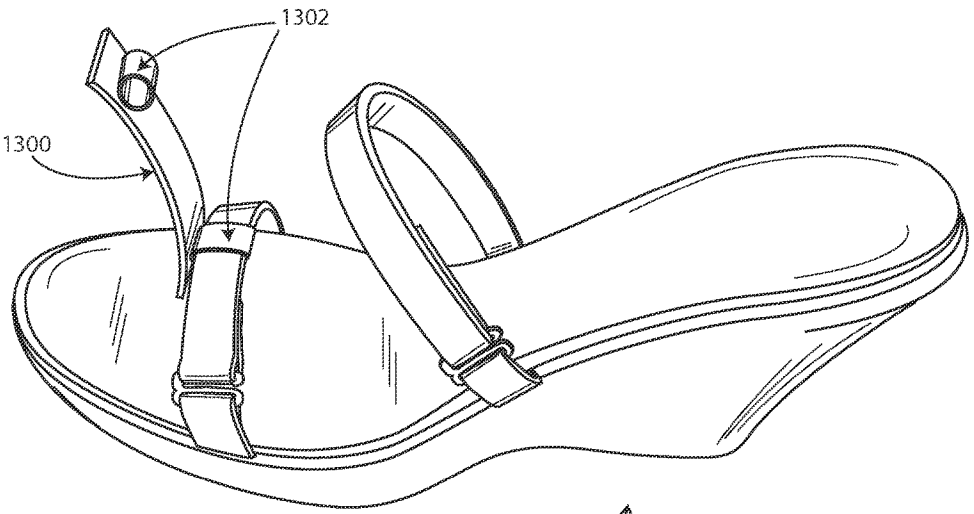
FIG. 13 is a partial perspective view of another decorative member with a plurality of loop fasteners in accordance with the present invention.
Figure 14:
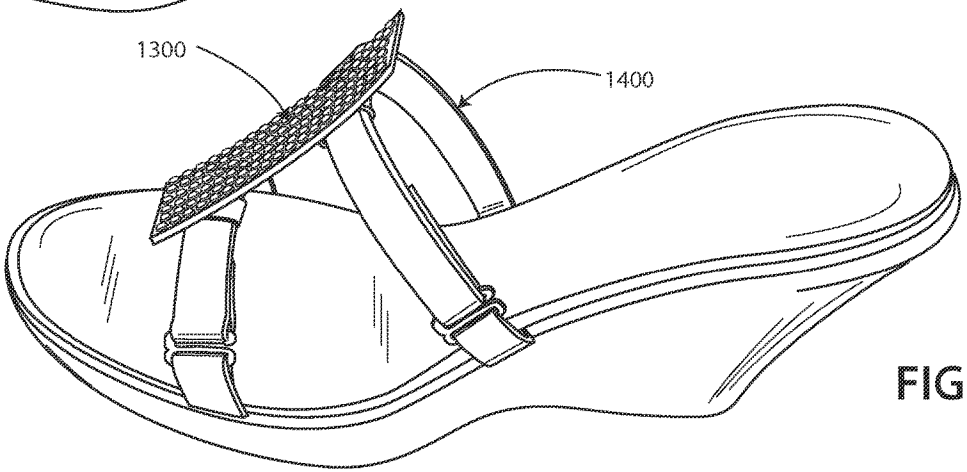
FIG. 14 is a partial perspective view of the decorative member of FIG. 13 selectively coupled to the article of footwear in FIG. 8 in accordance with an embodiment of the present invention.

Referring to FIGS. 13-14, another exemplary decorative member 1300 is illustrated with a pair of loops 1302 disposed on a surface thereof, the pair of loops 1302 sized and configured to receive a footwear strap 1400 therethrough for selectively coupling the decorative member 1300 to the footwear strap 1400.

Figure 15:
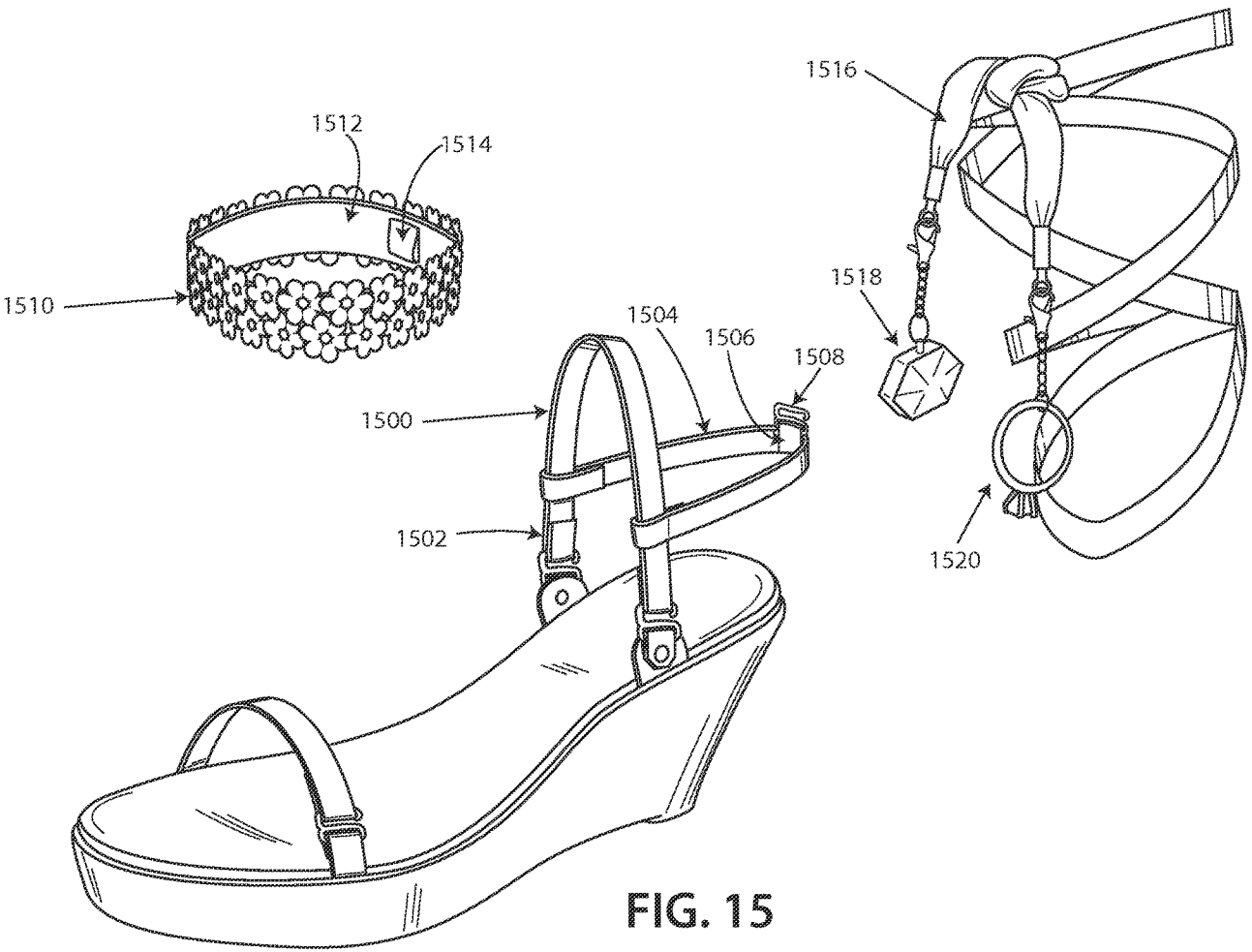
FIG. 15 is a partial perspective view of the article of footwear in FIG. 8, illustrating an exemplary ankle strap selectively coupled thereto, in accordance with an embodiment of the present invention.
Figure 16:
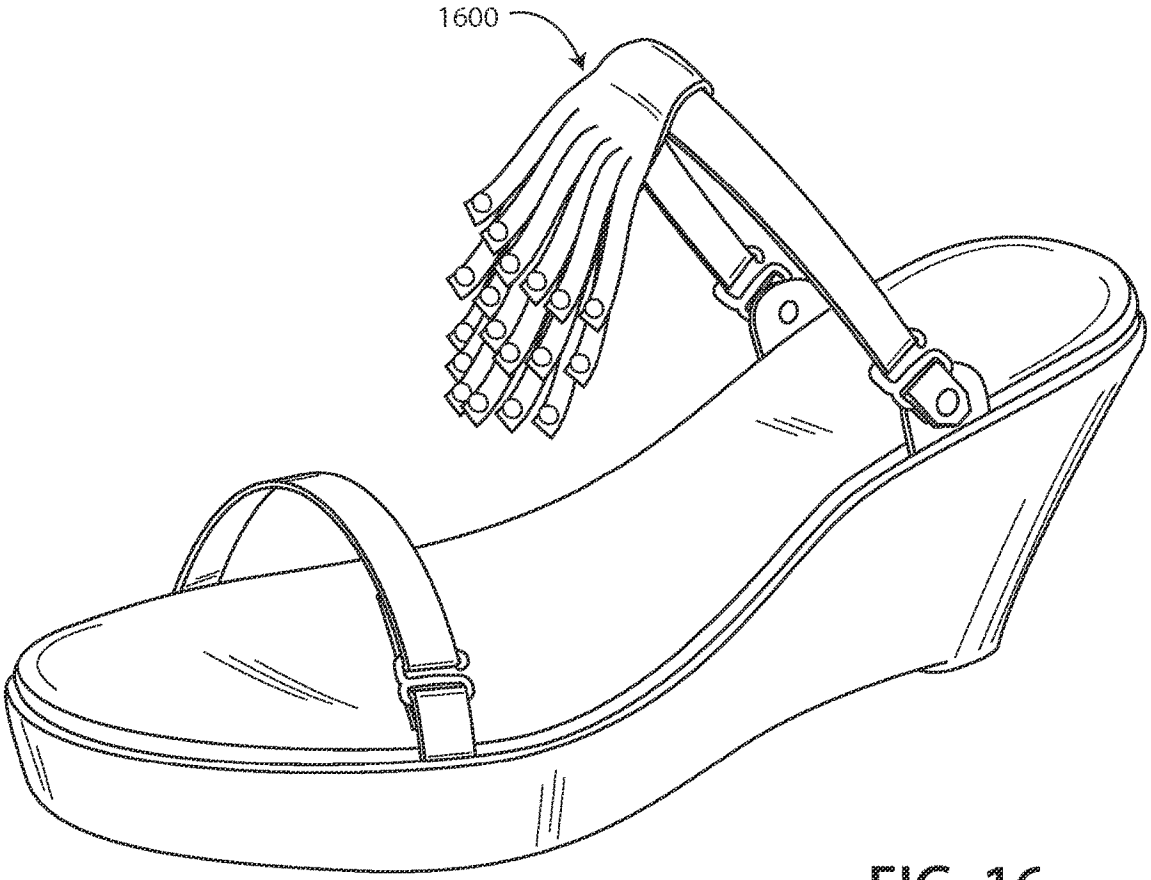
FIG. 16 is a partial perspective view of the article of footwear in FIG. 8, illustrating a decorative member selectively coupled thereto, in accordance with an embodiment of the present invention.

Referring to FIGS. 15-16, an exemplary ankle strap 1500 is illustrated in a perspective view. In one embodiment, the exemplary ankle strap 1500 can be segmented into two distinct straps, a front strap member 1502 and a rear strap member 1504. In another embodiment, the front strap member 1502 and the rear strap member 1504 are selectively couplable to one another via any coupling mechanism, such as, for example, a loop. In yet another embodiment, the rear strap member 1504 includes a loop that receives an end of the front strap member 1502 therethrough. The rear strap member 1504 can be slideably uncoupled from the front strap member 1502 so as to slide a loop of a decorative member 1600 thereon for selectively coupling the decorative member 1600 to the ankle strap 1500, as shown in FIG. 16. In one embodiment, the front strap member 1502 may be a different color from the rear strap member 1504 for increasing visual variety for the wearer.

In one exemplary embodiment, a fastener 1506 may be coupled to the rear strap member 1504. More specifically, in one embodiment, the fastener 1506 may include a hook arm 1508 configured so as to receive a decorative member 1510 thereon for further increasing the visual variety for the wearer. The decorative member 1510 may include an inner surface 1512 having a fastening portion 1514 operably configured to couple to the hook arm 1508. The decorative member 1510 may be, without limitation, an ankle strap having a decorative design, e.g., a floral design, an embellished jeweled design, a patterned fabric, or the like.

In another exemplary embodiment, a decorative member 1516 may be coupled to the fastener 1506. The decorative member 1516 may be a string, lace, or other piece of material, configured to wrap around a leg of the user. In one embodiment, the fastener 1506 may include one or more loops defining an aperture for inserting a portion of the decorative member 1516 through the aperture (not shown). The decorative member 1516 may include a plurality of decorative members 1518, 1520 coupled thereto. Advantageously, the decorative members 1518, 1520 may be removably coupled to the decorative member 1516 via any coupling mechanism, such as, for example, a clasp. The decorative members 1518, 1520 may be, without limitation, charms, pendants, jewels, or other decorative members designed to enhance the visual variety for the wearer. The decorative members 1518, 1520 may include symbols associated with various holidays and/or special events, e.g., a heart associated with the Valentine's day holiday, a ring associated with marriage, and the like.

Figure 17:
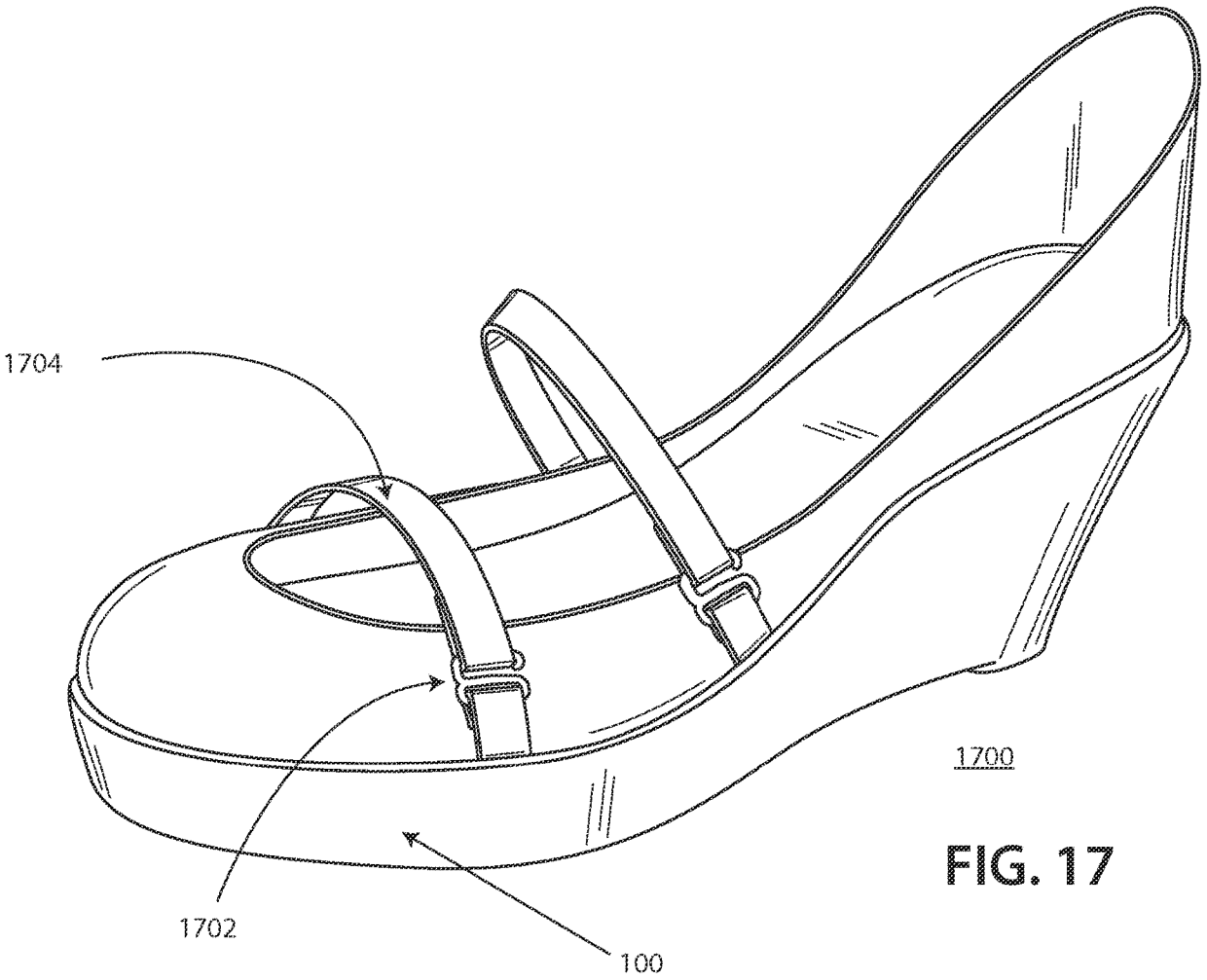
FIG. 17 is a is a front perspective view of a closed-toe pump in accordance with an embodiment of the present invention.
Figure 19:
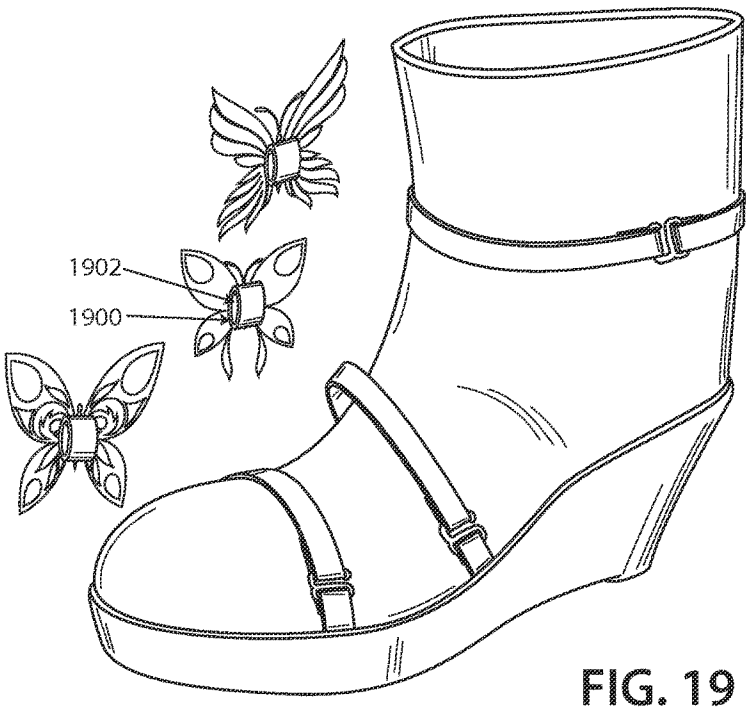
FIG. 19 is a partial perspective view of the boot of FIG. 18 showing a loop fastener for the decorative member in accordance with an embodiment of the present invention.
Figure 18:
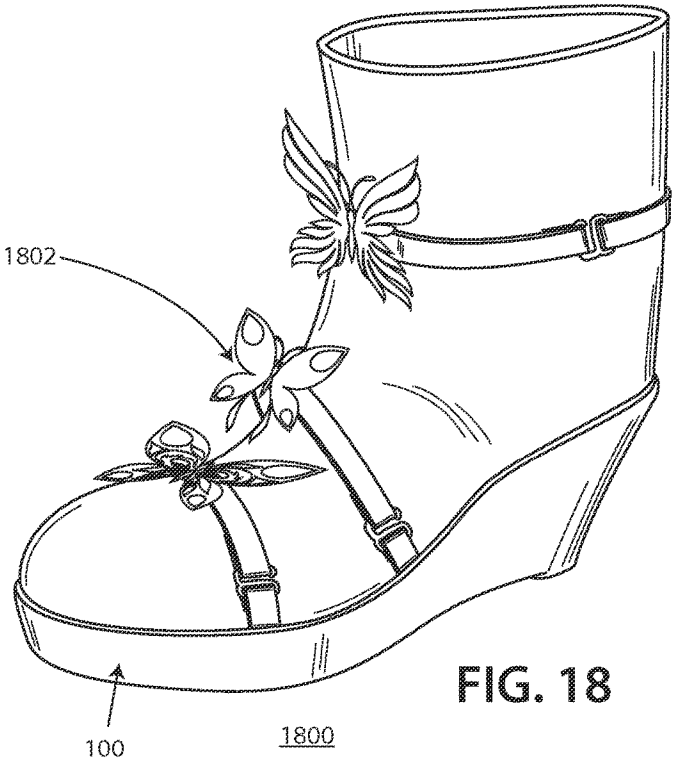
FIG. 18 is a partial perspective view of a boot in accordance with an embodiment of the present invention.

Referring to FIGS. 17-19, a plurality of exemplary closed-toe footwear embodiments are illustrated in various perspective views. FIG. 17 illustrates an embodiment where the sole member 100 is a sole of a pump 1700. In one embodiment, the pump 1700 includes one or more fastening members 1702 (similar to the first fastening member 106) and footwear straps 1704 (similar to the footwear strap 202) for selectively coupling various decorative members thereto in a manner similar to the manner described above for the wedge sandal embodiment. FIG. 18 illustrates an embodiment where the sole member 100 is a sole of a boot 1800. In one embodiment, the boot 1800 includes one or more fastening members (similar to the first fastening member 106) and footwear straps (similar to the footwear strap 202) for selectively coupling a decorative member 1802 thereto in a manner similar to the manner described above for the wedge sandal embodiment. In another embodiment, the decorative member 1802 includes one or more loops 1900 defining an aperture 1902 for receiving at least a portion of the footwear straps therethrough in order to selectively couple the decorative member 1802 to the boot 1800.

An article of footwear and a footwear kit has been disclosed that includes a sole member with fasteners that allow a user to selectively interchange decorative features and foot supporting/retaining straps to provide the user with decorative variety, without requiring the costly purchase of additional pairs of shoes. Advantageously, the present invention provides an easy to use and secure fastening member, similar to a bra-strap fastener, having a hook arm configured and oriented to allow the footwear strap to selectively couple to the hook arm for slideably coupling and uncoupling decorative members to the article of footwear. Embodiments of the invention can be provided in a variety of types of footwear, including but not limited to, sandals, pumps, boots, and the like.

What is claimed is:

1. A sole member for an article of footwear, the sole member comprising:

an outsole defining a ground-contacting portion of the sole member;

an insole defining a foot-contacting portion of the sole member; and a first fastening member coupled to a peripheral edge of at least one of the outsole and the insole, the first fastening member including:

a body with a hook arm protruding from a portion of the body, the hook arm and the portion together disposed above the insole and defining a discontinuous gap in the body; and a coupling strap with a fastener disposed on an exterior surface of the coupling strap and having a first end and a second end opposite the first end, the first end extending outwardly from the peripheral edge of the at least one of the outsole and the insole and the second end coupled to the portion of the body of the first fastening member; and a footwear strap including:

a first end and a second end opposite the first end, wherein the first end is fixedly coupled to the peripheral edge of the at least one of the outsole and the insole on one side of the sole member and the second end is selectively couplable to the first fastening member disposed on an opposing side of the sole member; and a flap disposed at the second end of the footwear strap, the flap having a mating fastener disposed on an interior surface thereof and configured so as to substantially conceal the hook arm when the fastener and the mating fastener are engaged.

2. The sole member in accordance with claim 1, wherein:

the portion of the body is formed as a closed-loop portion and the second end of the coupling strap is folded over the closed-loop portion of the body so as to form a loop about at least a portion of the closed-loop portion.

3. The sole member in accordance with claim 1, wherein:
the discontinuous gap is sized and configured to receive a footwear strap therethrough; and
an opening of the discontinuous gap is oriented towards a heel portion of the sole member.

4. The sole member in accordance with claim 1, wherein:
the coupling strap is of a flexible material and the body is of a material that is more rigid than the coupling strap.

5. The sole member in accordance with claim 1, wherein:
the hook arm of the body does not contact the coupling strap.

6. The sole member in accordance with claim 1, wherein:
the body is of a plastic material.

7. The sole member in accordance with claim 1, further comprising:
a rear fastening member extending outwardly from a rear portion of the peripheral edge of the sole member, the rear fastening member including a pivot and at least a portion of the rear fastening member rotatable about the pivot.

8. The sole member in accordance with claim 7, wherein:
the at least the portion of the rear fastening member is rotatable at least 45 degrees about a vertical axis defined by the pivot.

9. The sole member in accordance with claim 7, further comprising:
a second rear fastening member extending outwardly from the rear portion of the peripheral edge of the sole member, the second rear fastening member including a second pivot and at least a portion of the second rear fastening member rotatable about the second pivot; and
wherein:
the rear fastening member and the second rear fastening member are disposed on opposing sides of the sole member; and
the rear fastening member and the second rear fastening member are rotatable at least 45 degrees about the pivot and second pivot, respectively.

10. The sole member in accordance with claim 1, wherein:
the sole member is formed as a sole of a wedge sandal.

11. A decorative footwear kit comprising:
a sole member including:
an outsole defining a ground-contacting portion of the sole member;
an insole defining a foot-contacting portion of the sole member;
a first fastening member coupled to a peripheral edge of at least one of the outsole and the insole, the first fastening member including:
a body with a hook arm protruding from a portion of the body, the hook arm and the portion together disposed above the insole and defining a discontinuous gap in the body; and
a coupling strap with a fastener disposed on an exterior surface of the coupling strap and having a first end and a second end opposite the first end, the first end extending outwardly from the peripheral edge of the at least one of the outsole and the insole and the second end coupled to the portion of the body; and
at least one footwear strap selectively couplable to the first fastening member, the at least one footwear strap including:
a first end and a second end opposite the first end, wherein the first end is fixedly coupled to the peripheral edge of the at least one of the outsole and the insole on one side of the sole member and the second end is selectively couplable to the first fastening member disposed on an opposing side of the sole member; and
a flap disposed at the second end of the footwear strap, the flap having a mating fastener disposed on an interior surface thereof and configured so as to substantially conceal the hook arm when the fastener and the mating fastener are engaged.

12. The decorative footwear kit in accordance with claim 11, wherein:
the portion of the body is formed as a closed-loop portion and the second end of the coupling strap is folded over the closed-loop portion of the body so as to form a loop about at least a portion of the closed-loop portion.

13. The decorative footwear kit in accordance with claim 11, wherein:
the discontinuous gap is sized and configured to receive the at least one footwear strap therethrough; and
an opening of the discontinuous gap is oriented towards a heel portion of the sole member.

14. The decorative footwear kit in accordance with claim 11, further comprising:
at least one decorative member selectively couplable to the at least one footwear strap.

15. The decorative footwear kit in accordance with claim 14, wherein:
the at least one decorative member includes a loop sized and configured to slideably receive the at least one footwear strap therethrough for selectively coupling the at least one decorative member to the at least one footwear strap.

16. The decorative footwear kit in accordance with claim 11, further comprising:
a rear fastening member extending outwardly from a rear portion of the peripheral edge of the sole member, the rear fastening member including a pivot and at least a portion of the rear fastening member rotatable about the pivot; and
wherein the at least one footwear strap includes an ankle strap selectively couplable to the rear fastening member.

17. The decorative footwear kit in accordance with claim 11, further comprising:
a plurality of decorative members selectively couplable to the at least one footwear strap, wherein at least one of the plurality of decorative members is visually distinguishable from another one of the plurality of decorative members.

* * * * *